United States Patent [19]

Bui-Hai

[11] 4,410,866

[45] Oct. 18, 1983

[54] ANTENNA TRANSDUCER FOR A TRANSMISSION-RECEPTION ANTENNA

[75] Inventor: Nhu Bui-Hai, Paris, France

[73] Assignee: Thomson-CSF, Paris, France

[21] Appl. No.: 287,946

[22] Filed: Jul. 29, 1981

[30] Foreign Application Priority Data

Jul. 31, 1980 [FR] France ..... 80 16920

[51] Int. Cl.[3] ..... H01P 1/213

[52] U.S. Cl. ..... 333/135; 333/21 A; 333/208

[58] Field of Search ..... 333/126, 135, 21 A, 333/208; 343/786

[56] References Cited

U.S. PATENT DOCUMENTS

| | | | |
|---|---|---|---|
| 3,731,235 | 5/1973 | Ditullio et al. | 333/135 |
| 3,978,434 | 8/1976 | Morz et al. | 333/21 A X |
| 4,185,257 | 1/1980 | Nakajima | 333/208 |

OTHER PUBLICATIONS

Harkless, A., *Network for Combining Radio Systems at 4, 6 and 11 KMC,* Bell Tele. Tech. Jrnl., Sep. 1959, vol. 38, No. 5, pp. 1253–1263 cited.

*Primary Examiner*—Paul L. Gensler

*Attorney, Agent, or Firm*—Cushman, Darby & Cushman

[57] ABSTRACT

A transducer for coupling to an antenna with a first polarizing duplexer for working in a low-frequency band, a between-guide transition element formed from a variable-section guide and a second polarizing duplexer for working in a high-frequency band. In the polarizing openings of the first duplexer are placed dipoles resonating at the mean frequency of the high band which cause a short-circuit for the high frequencies and let the low frequencies pass. A set of quasioptical filters, situated in the body of the first duplexer, between the polarizing openings of this first duplexer and the transition element, causes a short-circuit for the low frequencies and lets the high frequencies pass.

6 Claims, 5 Drawing Figures

ANTENNA TRANSDUCER FOR A TRANSMISSION-RECEPTION ANTENNA

BACKGROUND OF THE INVENTION

The present invention relates to an antenna transducer comprising, in series from an access intended to be coupled to the radiating part of an antenna, a first polarizing duplexer for working in a first frequency band, a transition element formed from a variable-section guide and a second polarizing duplexer for working in a second frequency band.

The use of such antenna transducers for allowing an antenna to operate with great polarizing purity is known; the two frequency bands of these transducers are respectively a low-band for the working frequencies of the first polarizing duplexer and a high-band for the working frequencies of the second polarizing duplexer. These known transducers have their first polarizing duplexer which comprises four lateral polarizing accesses spaced apart by 90° from each other and the separation between the frequencies of the two bands takes place by means, on the one hand, of high-pass filters situated in the transition element and/or in the second polarizing duplexer and, on the other hand, low-pass filters placed in the lateral waveguides ending at the four lateral accesses of the first polarizing duplexer. The filters used in these known antenna transducers are filters with two or three cavities, adjustable by means of plungers, i.e. rods capable of being inserted to a greater or lesser extent in the cavities. Such antenna transducers present different drawbacks:

- they are expensive because of the filters which they use,
- their transmitting and receiving passbands are relatively small,
- resonance phenomena tend to occur in the high-frequency band, i.e. in the working frequency band of the second polarizing duplexer.

The present invention aims at considerably reducing the above drawbacks.

SUMMARY OF THE INVENTION

This is obtained by using a combination of means for providing, more especially, less expensive and more efficient filtering.

In accordance with the invention there is provided an antenna transducer comprising, in series, a first polarizing duplexer for working in a first frequency band, a transition element formed from a variable-section guide and a second polarizing duplexer for working in a second frequency band; the first polarizing duplexer comprising: a main waveguide having a first end for coupling to the radiating part of an antenna, a second end coupled to the transition element and n lateral polarizing openings (n: a whole even number greater than 0 and less than 6), n auxiliary guides ending respectively at the n lateral openings, dipoles resonating at the mean frequency of the second frequency band, placed in the n lateral openings and a set of m quasioptical filters (m being a whole number at least equal to 1), placed in the main guide between the lateral openings and the second end, at a distance from the n lateral openings of about ($\lambda/4$) ($\lambda$: mean wavelength in the first frequency band) and forming a short-circuit for the first frequency band.

BRIEF DESCRIPTION OF THE DRAWINGS

The present invention will be better understood and other characteristics will appear from the following description and accompanying figures which show.

In the different figures the corresponding elements are shown by the same symbols.

DESCRIPTION OF THE PREFERRED EMBODIMENTS

Figure 1:
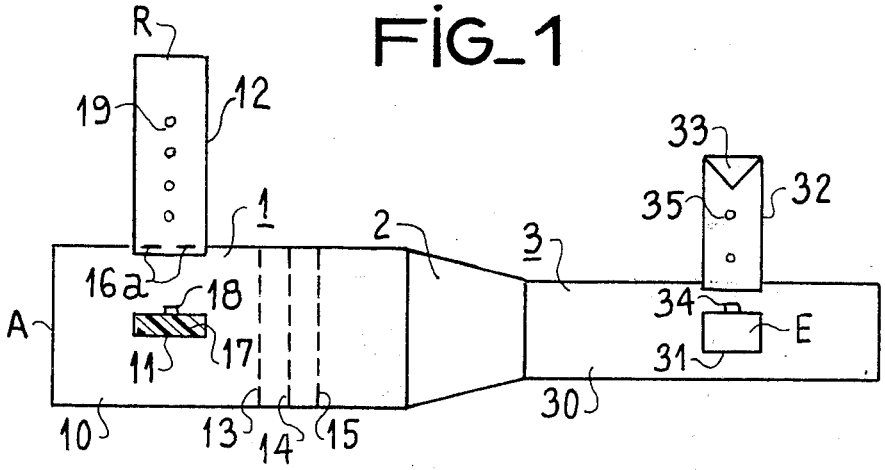
FIGS. 1 and 2 two views of a first embodiment of an antenna transducer in accordance with the invention.
Figure 2:
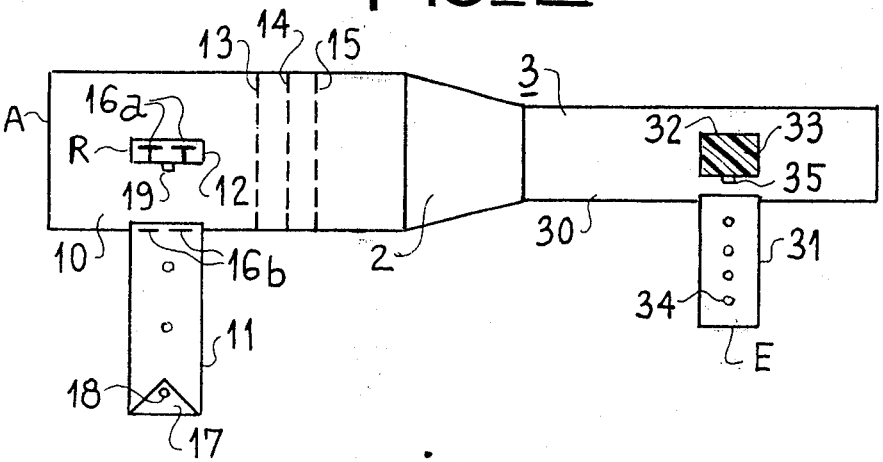
Figure 4:
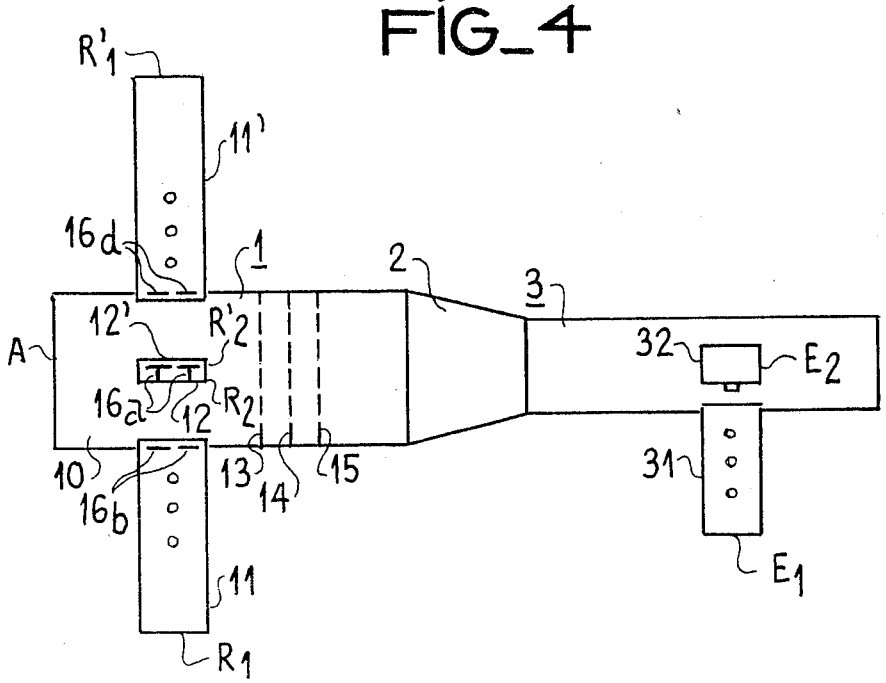
FIG. 4 a view of a second embodiment of the antenna transducer in accordance with the invention.

In FIGS. 1, 2 and 4 the proportions have not been exactly respected so as to better show certain elements.

FIGS. 1 and 2 are respectively a side view and a top view of an antenna transducer the internal elements of which are shown seen by transparency. This antenna transducer is designed so as to allow an antenna to operate at transmission and at reception with a single access E for transmission and a single access R for reception and a common access A intended to be coupled to the primary source of an antenna by a polarizer.

The antenna transducer of FIGS. 1 and 2 comprises, in series, from its common access A:

- a first polarizing duplexer 1, also called Orthomode (trademark) transducer or OMT,
- a between-guide transition 2,
- a second polarizing duplexer 3.

The first polarizing duplexer 1 has a body formed by a cylindrical guide 10, having an inner diameter of 54 mm, one end of which forms the common access A and the other end of which is connected to the transition element 2. This guide has two lateral polarizing openings, formed by rectangular holes 7 mm by 58 mm formed in the wall thereof at the same level but spaced 90° apart from each other. Two rectangular guides 11, 12, 7 mm by 58 mm, open into these openings; they comprise matching adjustment screws, such as 18 and 19 and, at the end thereof where they lead into the cylindrical guide 10, a pair (16*a*, 16*b*) of resonating dipoles; these dipoles are formed by metal Ts having a horizontal bar of 10 mm.

Guide 12 has its end opposite the cylindrical guide which forms the receiving access R of the antenna transducer.

In guide 11, at the end opposite the cylindrical guide 10, is placed a resistive load 17 of conventional type; in the case of the example described this load is formed from a material commercialized under the trademark DISARAL.

Figure 3:
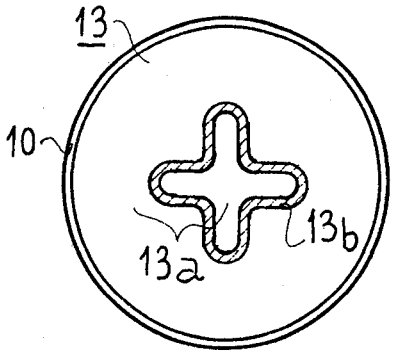
FIG. 3 a detailed view of one of the elements of FIGS. 1 and 2.

In the cylindrical guide 10, on the other side of the lateral openings with respect to the common access A and at a distance of 19 mm from these lateral openings, there is disposed a set of three identical quasioptical filters 13, 14, 15. FIG. 3 shows how filter 13 is mounted: this filter is formed by a crossed metal dipole 13*b* deposited on a dielectric support 13*a* made from beryllium oxide, integral with the wall of cylindrical guide 10 and perpendicular to the direction of propagation of the waves in this guide 10. Dipole 13*b* has an overall dimension of 26 mm.

The transition element 2 is a circular truncated cone-shaped guide whose maximum internal diameter is 54 mm and minimum internal diameter 34 mm.

The second polarizing duplexer of FIGS. 1 and 2 has a body formed by a cylindrical guide 30, with an internal diameter of 34 mm. Two rectangular openings of 35 mm by 16 mm are provided at 90° from each other in the lateral wall of cylindrical guide 30. Into these openings are fitted two rectangular guides 31, 32, whose internal section is 35 mm by 16 mm; the walls of guides 31, 32 have passing therethrough matching adjustment screws such as 34, 35. A resistive load 33, of the same type as resistive load 17, is disposed in guide 32, at the end of this guide opposite cylindrical guide 30. The end of guide 31 opposite the opening of cylindrical guide 30 forms the transmitting access E of the transducer.

The antenna transducer of FIGS. 1 and 2 is designed to operate for transmission with a frequency band included in the 6 GHz band (i.e. the band going from 5.925 to 6.425 GHz) and for reception with a frequency band within the 4 GHz band (i.e. the band going from 3.7 to 4.2 GHz). This antenna transducer operates as described below.

The quasioptical filters 13, 14, 15 have been designed so as to behave as short-circuits for the "reception" waves (4 GHz) and to let pass the "transmission" waves (6 GHz). With the first short-circuit plane placed at 19 mm from the opening at which guide 12 ends, i.e. at about $\lambda/4$ ($\lambda$: mean wavelength in the reception band), the energy of the "reception" waves reflected by this short-circuit are summed in phase, when they arrive in guide 12, with the "reception" energy which arrives directly into this guide, the path difference being in fact twice $\lambda/4$, i.e. $\lambda/2$.

The "T" dipoles, placed in the lateral openings of guide 10, are calculated so as to resonate at the mean transmitting frequency, they form then short-circuits for "transmission" waves. These dipoles thus allow the transmission-reception decoupling of the quasioptical filters to be completed by letting the "reception" waves pass while rejecting the "transmission" waves. As for load 17, it plays the role of a "mode absorber" for the crossed polarization of that received, due to parasite reflections.

The "round guide-round guide" transition element 2 provides progressive transition from the section of polarizing duplexer 1 to the section of polarizing duplexer 3.

The resistive load 33 disposed in the lateral guide 32 of polarizing duplexer 3 plays the role of a "mode absorber" for the crossed polarization of that transmitted. This crossed polarization arises through parasite reflections at the radiating part of the antenna: on the subreflector in the case, for example, of a Cassegrain antenna and at the antenna horn. Thus the transmitted wave, initially rectilinear in polarizing duplexer 3, becomes circular, circular to the right after passing through the polarizer for coupling to the antenna, then is transformed into circular polarization to the left after reflection. It then passes again through the polarizer and returns to the polarizing duplexer 1 with reverse polarization compared with its original polarization. This reverse polarization wave, if it were not absorbed by resistive load 17, would impair the ellipticity ratio for it would be reflected by the short-circuit formed by the quasioptical filters and would be sent to the radiating part of the antenna with a certain phase shift with respect to the original wave.

In association with a polarizer and a horn having a low ellipticity ratio, i.e. very much less than 0.5 dB, the transducer which has just been described allows a primary source to be obtained having great polarizing purity: less than 0.5 dB. This transducer was initially designed for ground-station antennae of the Cassegrain or focal-point illumination type, these antennae may moreover have symmetry of revolution or not.

Figure 5:
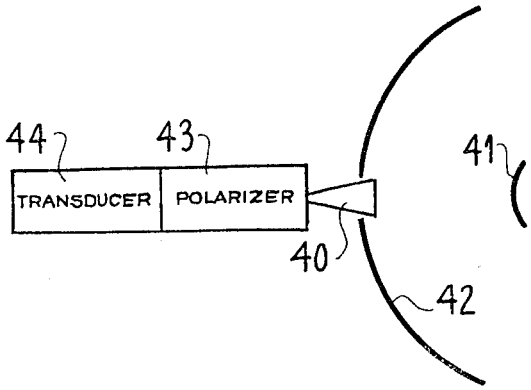
FIG. 5 a schematical view of an antenna comprising a transducer in accordance with the invention, in its primary source.

FIG. 5 shows such an antenna. FIG. 5 shows schematically a Cassegrain antenna with symmetry of revolution, seen in section, with its horn 40, its hyperboloidal-shaped subreflector 41 and its main paraboloidal-shaped reflector 42; a polarizer 43, whose role is to transform a rectilinear polarization field into a circular polarization field and vice versa, couples the radiating part of the antenna, 40, 41, 42, to an antenna transducer 44, in accordance with FIGS. 1 and 2.

Another embodiment of an antenna transducer in accordance with the invention is given in FIG. 4. The antenna transducer shown in this Figure is an antenna transducer with two transmission accesses $E_1$, $E_2$ and two pairs of reception accesses $R_1$ $R'_1$, $R_2$ $R'_2$.

The assembly of FIG. 4 comprises, as the assembly of FIGS. 1 and 2, three parts, from access A intended to be coupled, by means of a polarizer, to the radiating part of an antenna:

- a first polarizing duplexer 1 comprising a circular guide 10 with quasioptical filters 13, 14, 15 and lateral polarizing openings in each of which is disposed a pair of "T" dipoles such as 16*a*, 16*b*, 16*d*; a lateral access guide 11, 11', 12, 12' ends in each of these lateral openings,
- a "round guide-round guide" transition element 2,
- and a second polarizing duplexer 3 with two lateral access guides 31, 32.

The differences with the antenna transducer of FIGS. 1 and 2 comes from the fact that:

- guide 10 of the first polarizing duplexer does not have two but four lateral openings at 90° from each other,
- the lateral guides 11, 11', 12, 12' ending in the four lateral openings of guide 10 comprise no resistive load and are grouped together in pairs of opposite accesses $R_1$–$R'_1$, $R_2$–$R'_2$, by means of a magic T and connection guides so as not to overload the circuit of FIG. 4 and because such an assembly is conventional; a vertical-polarization reception access and a horizontal-polarization reception access are thus available respectively at the two magic Ts of these groupings,
- the lateral guide 32 of the second polarizing duplexer 3, like lateral guide 31, comprises no resistive load and forms a second transmission access $E_2$ of the antenna transducer; the first transmission access $E_1$ corresponds to the access E of FIGS. 1 and 2 and is intended to transmit rectilinear waves, with polarization orthogonal to the waves transmitted by access $E_2$.

In association with a polarizer and a horn providing an ellipticity ratio very less than 0.5 dB, the antenna transducer of FIG. 4 enables a source to be formed with great polarizing purity (less than 0.5 dB) with transmitting and reception frequencies chosen as follows:

- reception frequencies taken in the 4 GHz band: 3.7–4.2 GHz,
- transmission frequencies taken in the 6 GHz band: 5.925–6.425 GHz.

What is claimed is:

1. An antenna transducer comprising, in series, a first polarizing duplexer for working in a first frequency band, a transition element formed from a variable-section guide and a second polarizing duplexer for working in a second frequency band; the first polarizing duplexer comprising: a main waveguide having a first end for coupling to the radiating part of an antenna, a second end coupled to the transition element and n lateral polarizing openings (n being a whole even number greater than 0 and less than 6), n auxiliary guides terminating respectively at the n lateral openings, dipoles resonating at the mean frequency of the second frequency band, placed in the n lateral openings and a set of m filters (m being a whole number at least equal to 1), placed in the main guide between lateral openings and the second end, at a distance from the n lateral openings of about ($\lambda/4$) ($\lambda$ being the wavelength in the first frequency band) and forming a short-circuit for the first frequency band.

2. The antenna transducer as claimed in claim 1, wherein $n=2$ and wherein a resistive load is placed in one of the two auxiliary guides.

3. The antenna transducer as claimed in claim 2, wherein the second polarizing duplexer comprises: a main waveguide having two polarizing openings, two auxiliary guides terminating respectively at the two polarizing openings of the main waveguide of the second duplexer, and a resistive load placed in one of the two auxiliary guides of the second duplexer, the other one of these two auxiliary guides of the second duplexer serving as an access for waves included in the second frequency band.

4. The antenna transducer as claimed in claim 1, wherein the filters are quasioptical filters each formed by a metal dipole deposited on a flat dielectric support disposed in the main waveguide of the first polarizing duplexer, perpendicularly to the direction of propagation of the waves in the main waveguide of the first polarizing duplexer.

5. The antenna transducer as claimed in claim 1, wherein $n=4$.

6. The antenna transducer as claimed in claim 5, wherein the second polarizing duplexer comprises: a main waveguide having two polarizing openings and two auxiliary guides terminating respectively in the two polarizing openings of the main waveguide of the second duplexer, the two auxiliary guides of the second polarizing duplexer serving respectively as access for two waves with polarizations orthogonal to each other and at frequencies included in the second frequency band.

* * * * *